US011214070B2

(12) United States Patent
Borrego Lebrato et al.

(10) Patent No.: US 11,214,070 B2
(45) Date of Patent: Jan. 4, 2022

(54) COLLECTION OF LIQUID EJECTED FROM A PRINTHEAD

(71) Applicant: HP SCITEX LTD., Netanya (IL)

(72) Inventors: Alberto Borrego Lebrato, Sant Cugat del Valles (ES); Alon Levin, Netanya (IL); Jordi Lluch, Sant Cugat del Valles (ES); Xavier Gros, Sant Cugat del Valles (ES)

(73) Assignee: HP SCITEX LTD., Netanya (IL)

( * ) Notice: Subject to any disclaimer, the term of this patent is extended or adjusted under 35 U.S.C. 154(b) by 80 days.

(21) Appl. No.: 16/743,936

(22) Filed: Jan. 15, 2020

(65) Prior Publication Data

US 2020/0238712 A1 Jul. 30, 2020

(30) Foreign Application Priority Data

Jan. 30, 2019 (EP) ..... 19154487

(51) Int. Cl.

*B41J 2/17* (2006.01)
*B41J 2/175* (2006.01)
*B41J 2/165* (2006.01)

(52) U.S. Cl.

CPC ..... *B41J 2/1721* (2013.01); *B41J 2/16505* (2013.01); *B41J 2/16523* (2013.01); *B41J 2/17566* (2013.01)

(58) Field of Classification Search

CPC .. B41J 2/1721; B41J 2/16505; B41J 2/16523; B41J 2/17566; B41J 2/16526; B41J 2/16508; B41J 2/16511

See application file for complete search history.

(56) References Cited

U.S. PATENT DOCUMENTS

| | | | | |
|---|---|---|---|---|
| 6,293,641 | B1 * | 9/2001 | Yoshimura | B41J 2/16508 347/14 |
| 6,337,959 | B1 | 1/2002 | Kwak et al. | |
| 6,943,566 | B2 | 9/2005 | Florin et al. | |
| 7,419,239 | B2 | 9/2008 | Brown et al. | |
| 7,798,586 | B2 | 9/2010 | Watanabe | |
| 7,814,582 | B2 | 10/2010 | Reddy et al. | |
| 8,841,926 | B2 | 9/2014 | Fuetterer et al. | |
| 9,079,414 | B2 | 7/2015 | Lester et al. | |
| 2004/0104959 | A1 | 6/2004 | Brown et al. | |
| 2006/0181569 | A1 * | 8/2006 | Kawashima | B41J 29/17 347/36 |
| 2009/0040262 | A1 * | 2/2009 | Watanabe | B41J 2/17566 347/19 |
| 2017/0106656 | A1 * | 4/2017 | Conzelmann | B41J 2/16505 |
| 2017/0106687 | A1 | 4/2017 | Ono et al. | |
| 2019/0193405 | A1 * | 6/2019 | Suzuki | B41J 2/185 |

FOREIGN PATENT DOCUMENTS

| | | |
|---|---|---|
| EP | 1691177 A1 | 8/2006 |
| WO | WO-2015159659 | 4/2017 |

* cited by examiner

*Primary Examiner* — Henok D Legesse
(74) *Attorney, Agent, or Firm* — HP Inc. Patent Department

(57) ABSTRACT

In an example of the disclosure, a printhead is caused to spit a liquid into a main cavity of a container. The container includes an overflow pocket for collecting liquid that has overflown from the main cavity. A sensor is caused to detect whether liquid is present in the overflow pocket. Responsive to sensor detection that liquid is present in the overflow pocket, a warning or instruction message is caused to be sent for user consumption.

9 Claims, 12 Drawing Sheets

COLLECTION OF LIQUID EJECTED FROM A PRINTHEAD

BACKGROUND

Printing systems, such as inkjet printers, may include one or more printheads. Each printhead includes a printhead face having a series of nozzles that are used to spray drops of print agent upon a substrate. During operation of the printing systems, the printhead face may accumulate contaminants such as dried printing fluid or drying ink. Such contaminants can partially or completely clog nozzles so as to severely affect the performance of the printing system and print quality.

DRAWINGS

Figure 4A:
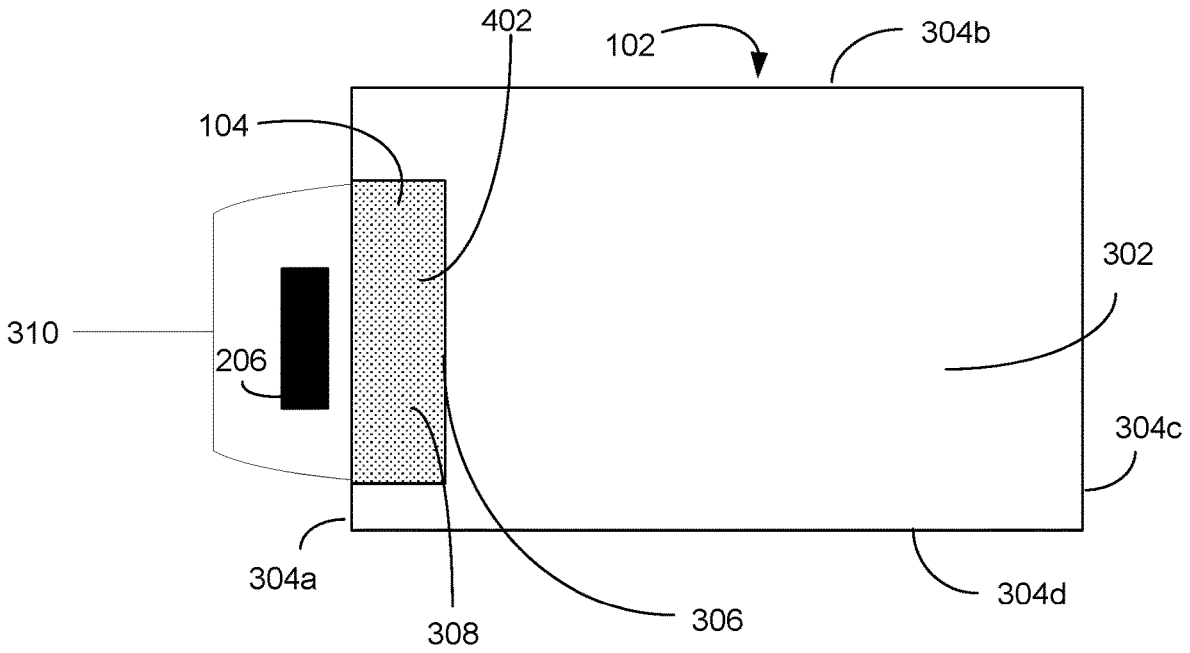
Figure 4B:
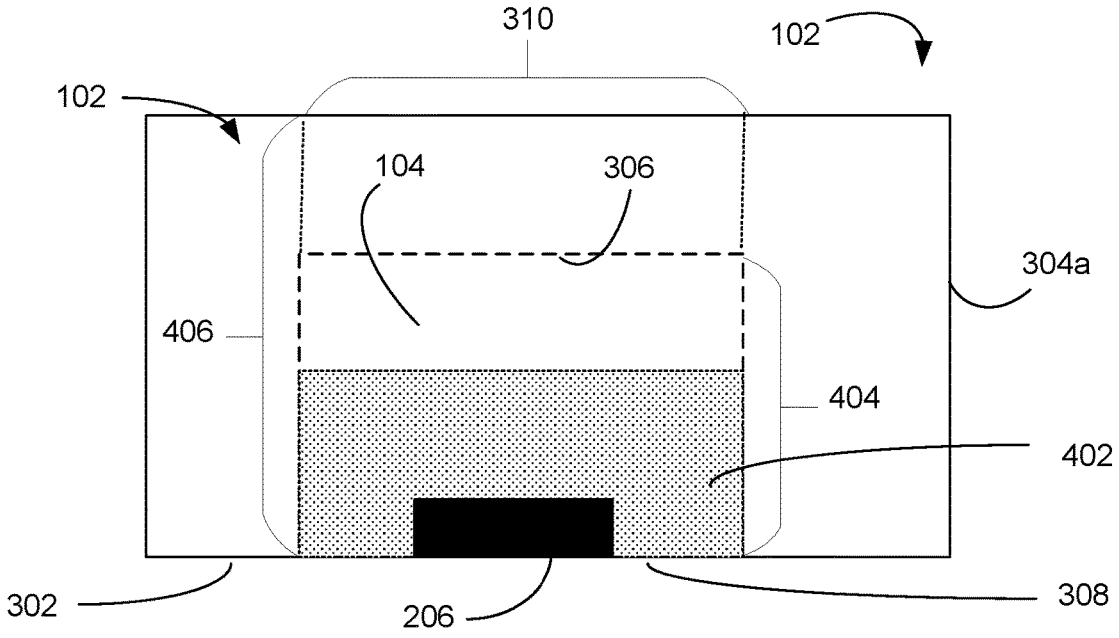
Figure 4C:
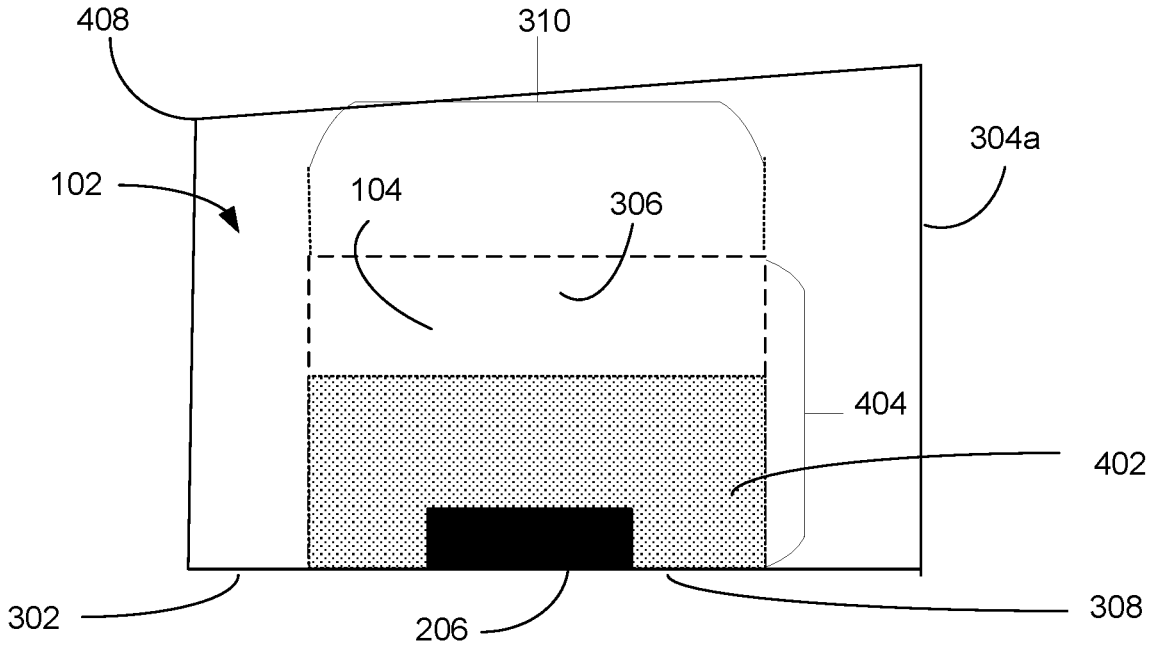

FIGS. 4A, 4B, and 4C are simple schematic diagrams that illustrate a top down view and profile views of an example of a system for collection of liquid ejected from a printhead.

Figure 5A:
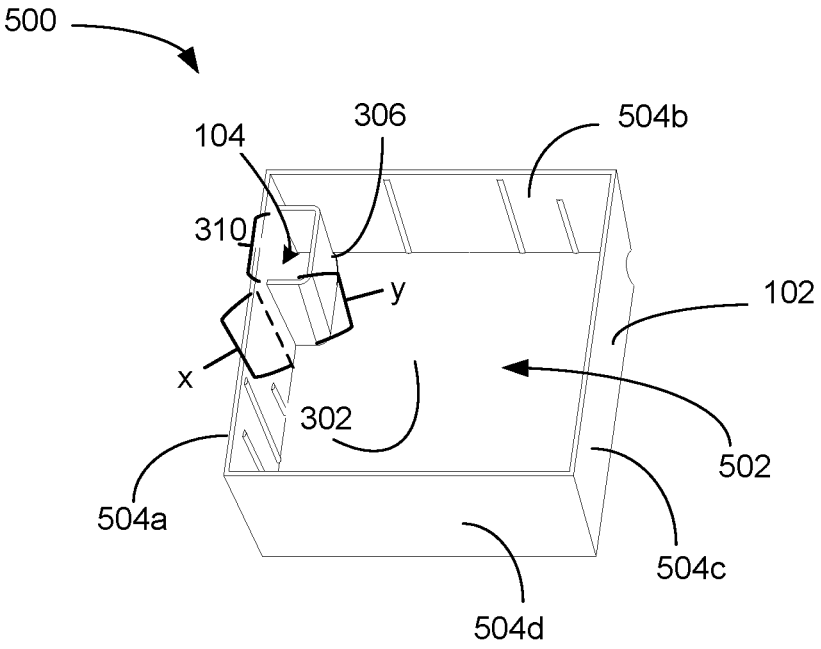
Figure 5B:
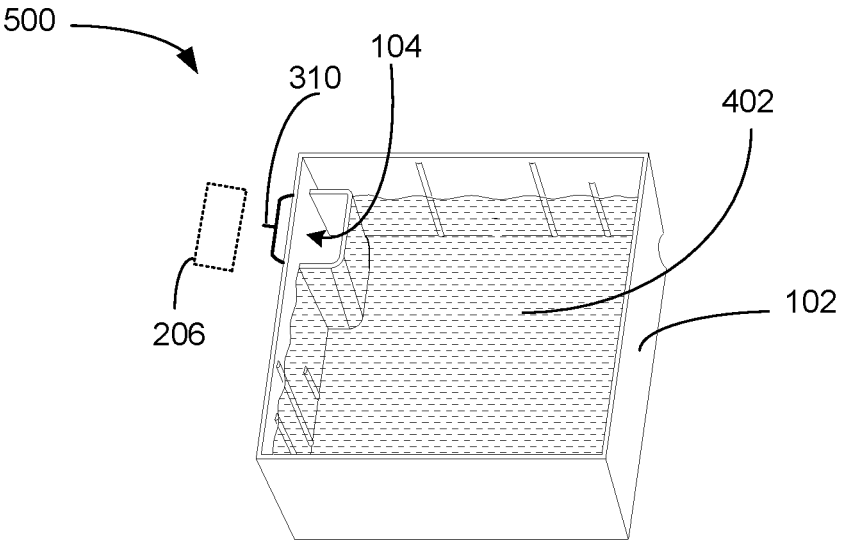

FIGS. 5A and 5B are top down views of an example of a system for collection of liquid ejected from a printhead.

Figure 6A:
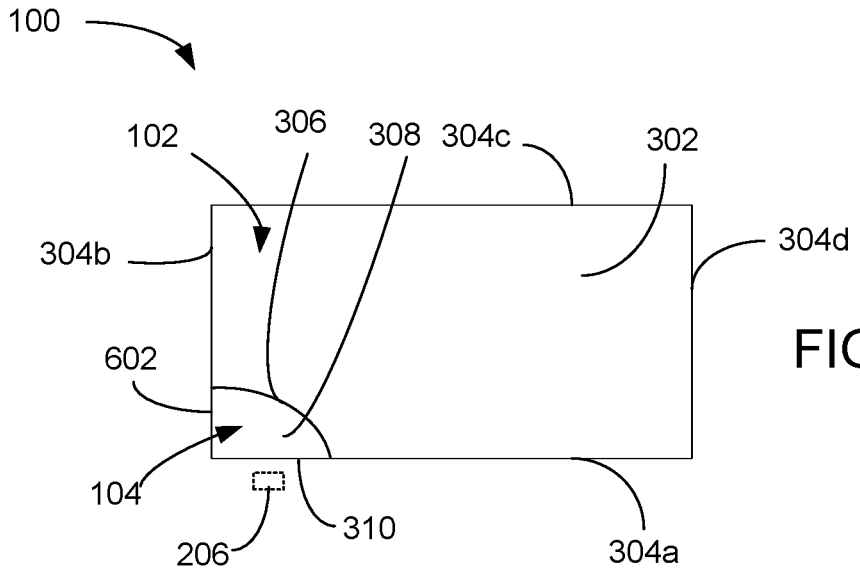
Figure 6B:
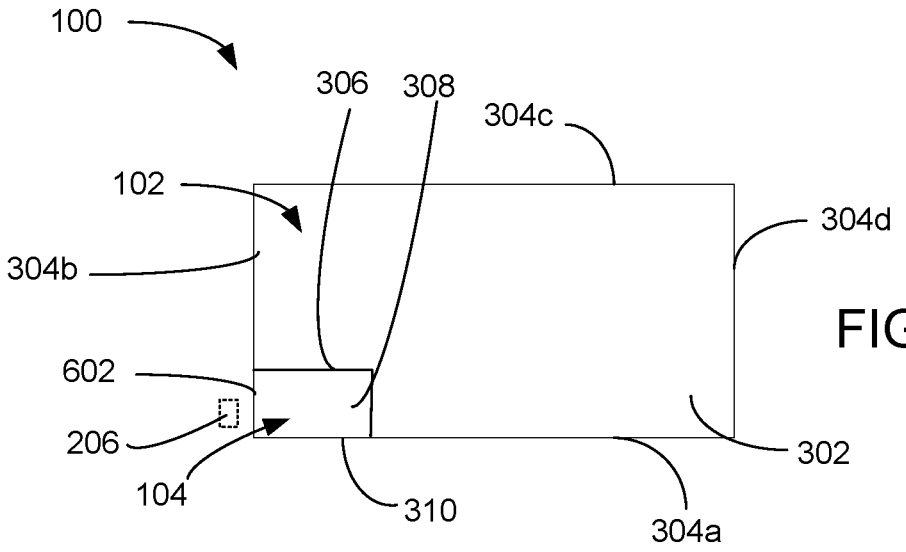
Figure 6C:
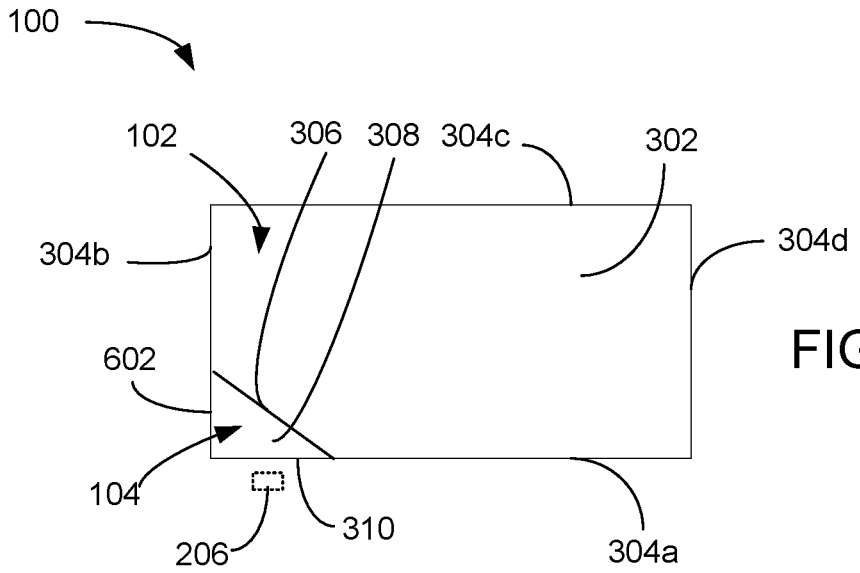

FIGS. 6A, 6B, and 6C are simple schematic diagrams that illustrate top down views of examples of a system for collection of liquid ejected from a printhead, wherein the overflow pocket is formed by portions of a first container wall and a second container wall.

Figure 7A:
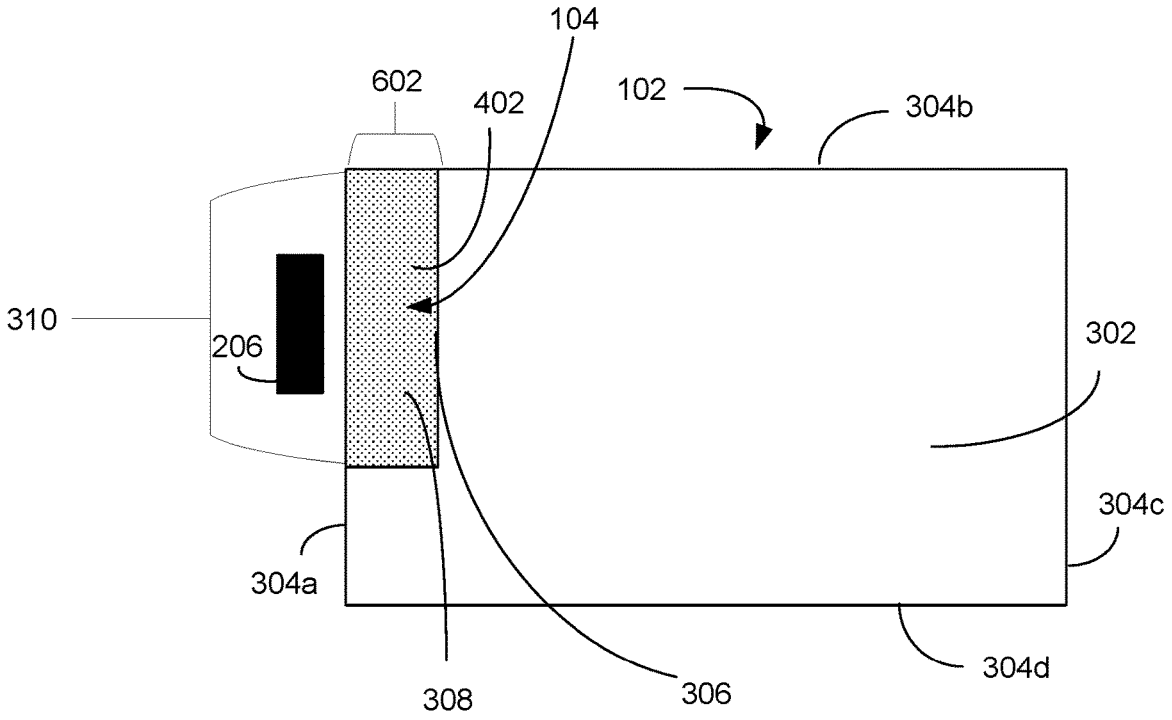
Figure 7B:
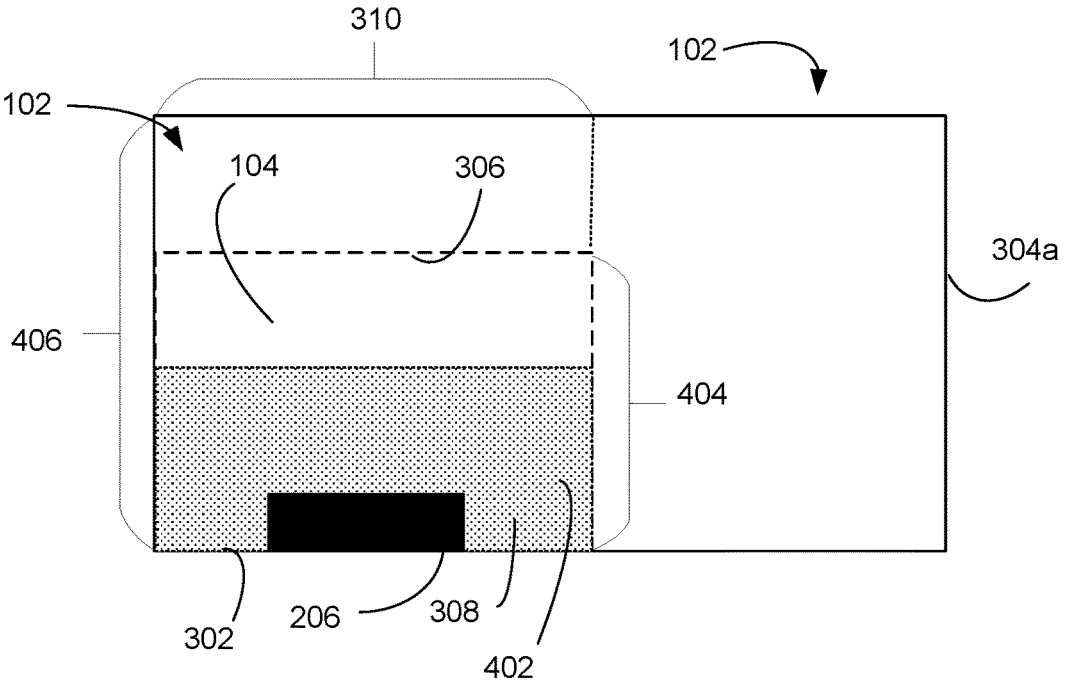

FIGS. 7A and 7B are simple schematic diagrams that illustrate a top down view and profile views of an example of a system for collection of liquid ejected from a printhead, wherein the overflow pocket is formed by portions of a first container wall and a second container wall.

Figure 8A:
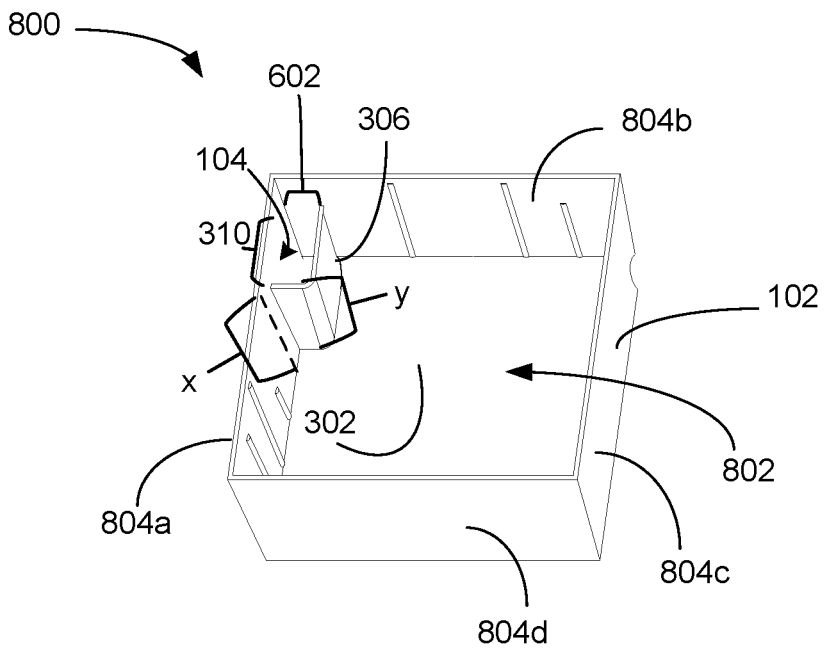
Figure 8B:
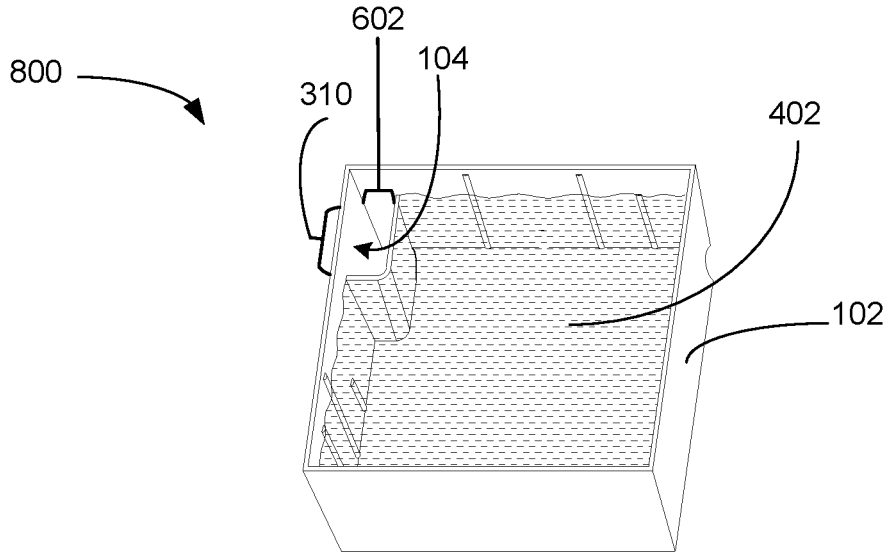

FIGS. 8A and 8B are top down views of another example of a system for collection of liquid ejected from a printhead.

Figure 9:
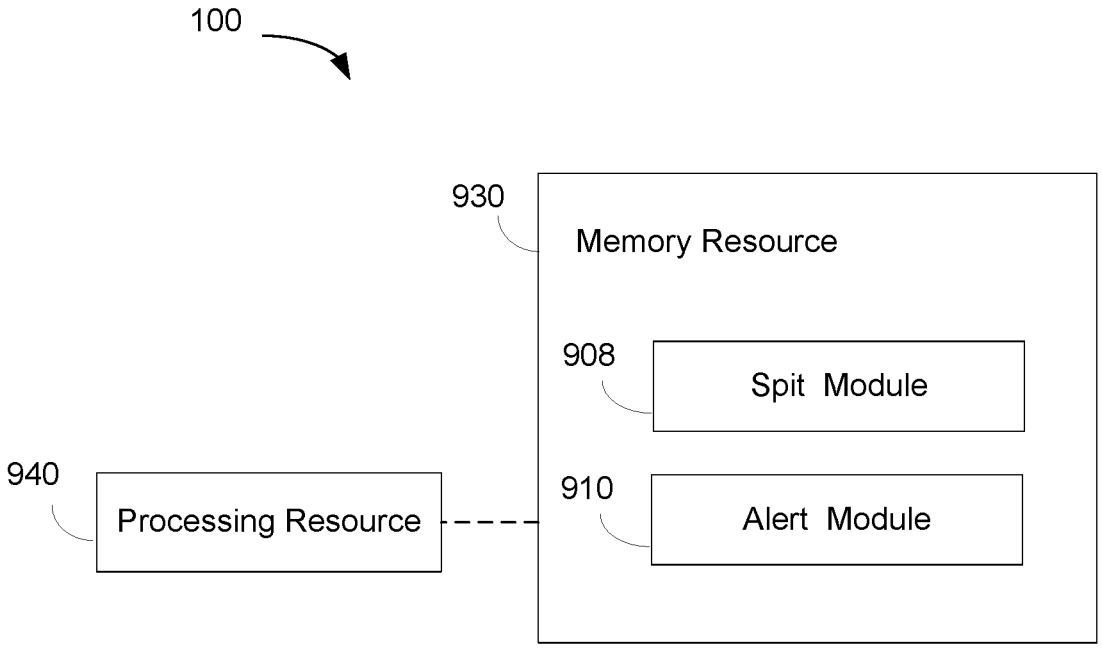

FIG. 9 is a block diagram depicting a memory resource and a processing resource to implement an example of a method for collection of liquid ejected from a printhead.

Figure 10:
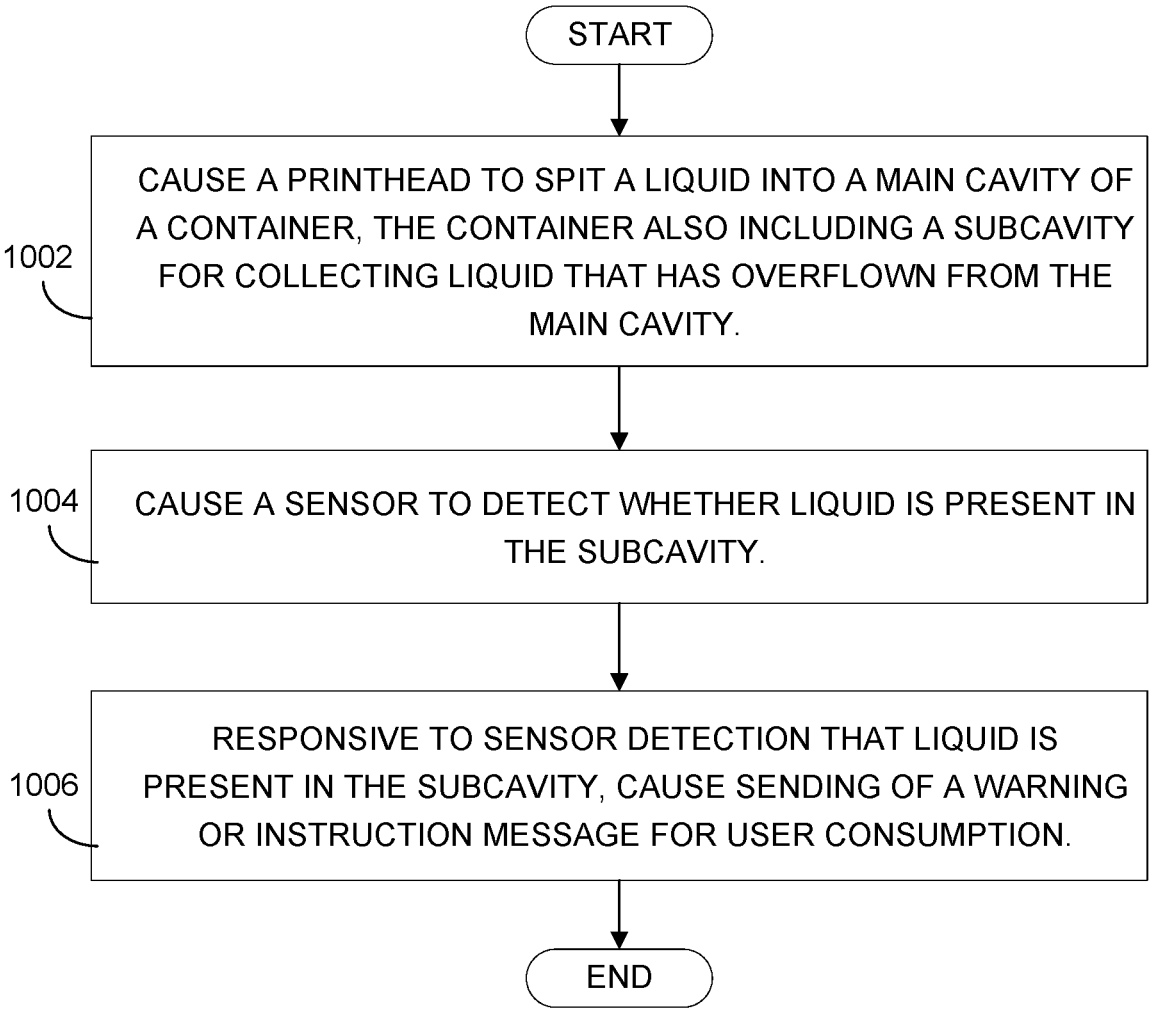

FIG. 10 is a flow diagram depicting an example implementation of a method for collection of liquid ejected from a printhead.

DETAILED DESCRIPTION

In some printer systems, an issue of issue of dried ink and other contaminants accumulating at printhead nozzles is addressed by periodically causing the printheads nozzles to spit ink into an ink collection container. In certain systems the collection container (sometimes referred to as a spittoon) is a consumable, such that when the collection container is filled with ink it is to be removed and discarded, to be replaced with a new collection container.

As any overflow of the spit ink from the ink collection container can cause downtime for cleanup and possibly severe damage to the printing system, the printing system should have an accurate reading of when the ink collection container is full. Various systems and methods have been utilized to detect when overflow at the ink collection container is imminent. In some systems a drop counter tracks the amount of ink deposited in the ink collection container, with the drop counter data being used to estimate how much ink is present in the ink collection container. When the system determines that the ink collection container is full according to the drop detector data, the system provides a user instruction to replace the container. However, if the drop counter performs abnormally, or if an expected user event occurs that disrupts the drop counting procedure (e.g., a user replacing an ink collection container with a non-empty one), there is a substantial risk the spit ink will exceed the maximum volume of the ink collection container and cause an ink overflow into the printer.

In some systems the disposable container includes a sensor for determining a level of ink in the disposable container. For instance, in some systems the ink collection container may include a liquid detection sensor or a floating mechanism for detecting the ink level. These systems can add significantly to the bill of materials for the disposable ink collection container.

Other systems may have a sensor external to the disposable ink collection container, the sensor to read an ink level through a wall of the ink collection container and to determine time for replacement by comparing the sensed ink level to a threshold level. These solutions depend upon very accurate positioning of the external sensor relative to the disposable ink collection container, with ink level sensing adding to the complexity and cost of the printer. The complexity of these systems can contribute to printer downtime, e.g. downtime associated with sensor alignment or other calibration processes, and downtime associated with failure of the sensitive ink level sensing components.

To address these issues, various examples described in more detail below provide a new system and a method for servicing a printhead by collecting ink or other liquid ejected from a printhead. In an example of the disclosure, a printhead is caused to spit a liquid into a main cavity of a container, the container also including a subcavity, sometimes referred to herein as an overflow pocket, for collecting liquid that has overflown from the main cavity. A sensor is caused to detect whether liquid is present in the subcavity. Responsive to sensor detection that liquid is present in the subcavity, a message is caused to be sent to a user interface for user consumption. The message is to inform a user that the container is due to be replaced and/or to instruct the user replace the container. In an examples the sensor is situated outside the main cavity of the container and adjacent to a shared wall as between the main cavity and the subcavity. In examples, the sensor is an inductive sensor or a capacitive sensor to detect the presence of liquid inside the subcavity. In examples, as the sensor is to detect the presence of liquid in the subcavity, as opposed to a specific quantity of liquid, calibration of the sensor is not required upon user replacement of the container with a new container.

In an example of the disclosure, a liquid collection system includes a container that has a floor and a set of container walls, and an overflow pocket that is formed by a portion of at least one of the container walls and a connecting member. The container has a main cavity that is for collection of liquid that has been spit from a printhead. The overflow pocket is to collect liquid for detection by a sensor situated outside the container and adjacent the container wall portion.

In this manner the disclosed method and system provides significant benefits relative to existing commercial solutions. The disclosed method and system reduce ink collection container overflows and thereby reduce the associated printer downtimes printer downtimes. User replacement of a full collection container is made easier, and takes less time, relative to existing systems that depend upon measuring a threshold level of ink in the liquid collection container. The disclosed method and system do not require an accurate position of the sensor relative to a threshold level of ink as do existing systems, and therefore the bill of materials cost for the system, and the number of major printhead servicing errors (e.g., occurrences of ink overflowing from the liquid collection container onto other printer components due to errant ink level readings) will be considerably reduced. Users and providers of inkjet printer systems will appreciate the reduced cost, increased accuracy, faster ink collection container replacement, and reductions in printer downtime that are afforded by utilization of the disclosed examples. Installations and utilization of printers that include the disclosed liquid collection method and system should thereby be enhanced.

Figure 1:
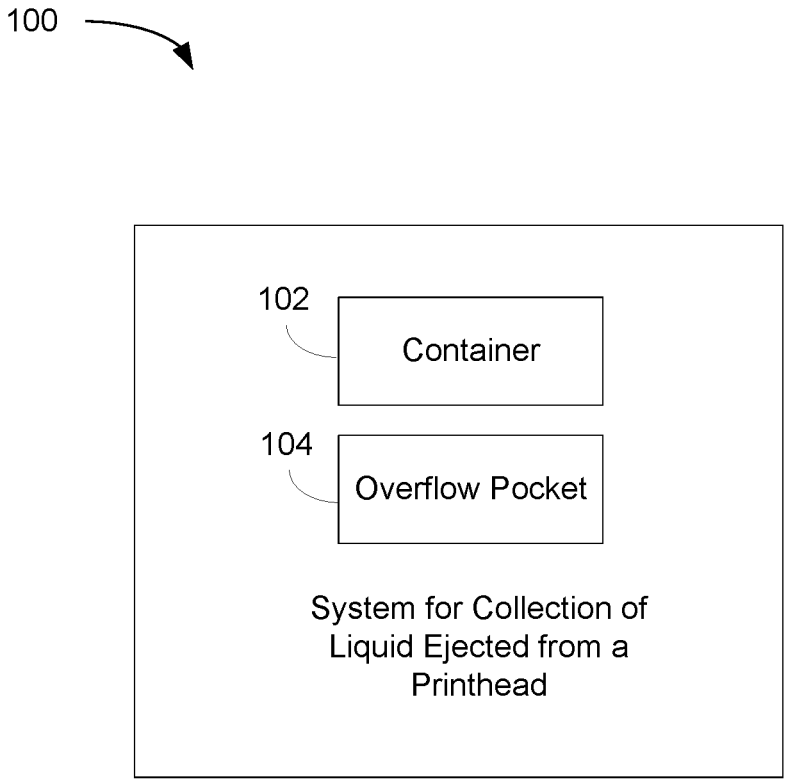
FIG. 1 is a block diagram depicting an example of a system for collection of liquid ejected from a printhead.
Figure 2:
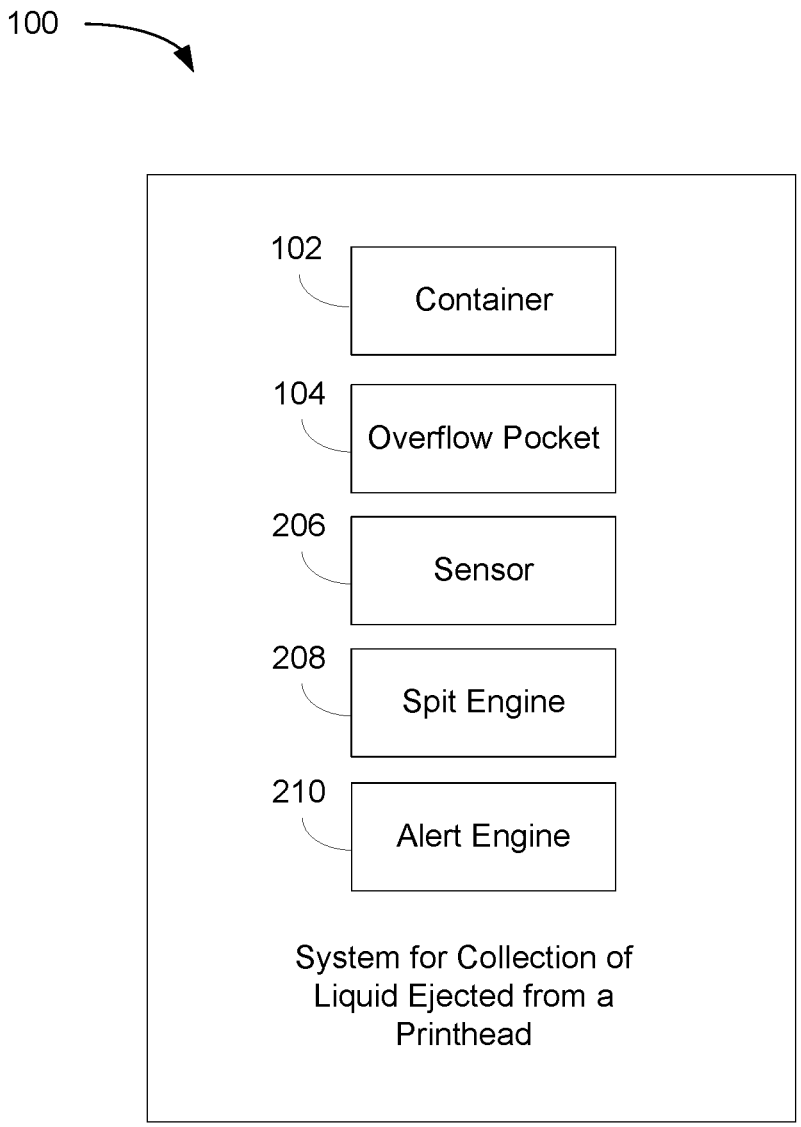
FIG. 2 is a block diagram depicting another example of a system for collection of liquid ejected from a printhead.

FIGS. 1 and 2 depict examples of physical and logical components for implementing various examples. In FIG. 2 various components are identified as engines 208 and 210. In describing engines 208 and 210 focus is on each engine's designated function. However, the term engine, as used herein, refers generally to hardware and/or programming to perform a designated function. As is illustrated with respect to FIG. 9, the hardware of each engine, for example, may include one or both of a processor and a memory, while the programming may be code stored on that memory and executable by the processor to perform the designated function.

FIG. 1 is a block diagram depicting an example of a system for collection of liquid ejected from a printhead. In this example, system 100 includes a container 102 and an overflow pocket 104. Container 102 includes a floor, and a container wall that defines, or at least partially defines, a perimeter of container 102. Overflow pocket 104 is formed by a connecting member and a portion of the one container wall.

Overflow pocket 104 is to collect liquid that has overflown from a main cavity of container 102. The collected liquid is to be detected by a sensor situated outside container 102 and adjacent the container wall portion. In examples, system 100 may, upon detection of the liquid collected in overflow pocket 104, send a user warning or user instruction message that disposable container 102 is ready to be removed and replaced.

FIG. 2 is a block diagram depicting another example of a system for collection of liquid ejected from a printhead. In this example, system 100 includes sensor 206. In one example, sensor 206 may be a capacitive sensor for detecting liquid that has overflowed from a main cavity of container 102 into overflow pocket 104. As used herein, a "capacitive sensor" refers generally to a sensor that can detect the presence of an object, even a nonconductive object, according to dielectric constant of the object. This makes both non-metal and metal liquids (e.g. an ink containing particles of bronze, aluminum, copper, zinc, silver, and/or gold) suitable targets for the capacitive sensor. In examples, and capacitive sensor 206 may detect the presence in the overflow pocket of a nonmetallic water-based ink, as may be used with thermal inkjet printheads. In other examples, sensor 206 may be an inductive sensor. As used herein, an "inductive sensor" refers generally to a sensor that utilizes a magnetic field to detect an object. This makes metal inks suitable targets for the inductive sensor. In examples, an inductive sensor 206 may detect the presence in the overflow pocket of a metallic water-based ink, as may be used with thermal inkjet printheads. In other examples, sensor 206 may be any apparatus for detecting liquid in overflow pocket 104 that does not contact the liquid (e.g., any apparatus that uses contactless sensing).

In examples, system 100 may include a spit engine 208 and an alert engine 210. Spit engine 210 represents generally a combination of hardware and programming to cause a printhead to spit ink or other liquid, into a main cavity of container 102. As used herein, a "printhead" refers generally to a mechanism for ejection of a liquid. In some examples the ejected liquid is a print agent. Examples of printheads are drop on demand inkjet printheads, such as piezoelectric printheads and thermo resistive printheads. Some printheads may be part of a cartridge which also stores the fluid to be dispensed. Other printheads are standalone and are supplied with fluid by an off-axis fluid supply. As used herein, "print agent" refers generally to any substance that can be applied upon a media by a printer during a printing operation, including but not limited to inks, primers and overcoat materials (such as a varnish). As used herein an "ink" refers generally to a fluid that is to be applied to a media during a printing operation to form an image upon the media. As used herein, a "printer" refers generally to liquid inkjet printer, solid toner-based printer, liquid toner-based printer, or any other electronic device that is to print a plot. "Printer" includes any multifunctional electronic device that performs a function such as scanning and/or copying in addition to printing.

Alert engine 210 represents generally a combination of hardware and programming to cause sensor 206 to detect whether liquid is present in overflow pocket 104, wherein the liquid overflowed from the main cavity of container 102 into the overflow pocket. Upon receiving data indicative that sensor 206 has detected liquid in overflow pocket 104, alert engine 210 is to cause a user warning message or a user instruction be sent to a monitor, screen, speaker or other message output component for user consumption. In one example, alert engine 210 may receive the data directly from sensor 206. In another example, alert engine 207 may receive the data from a memory or a processor. In an example, the user warning message or user instruction may be a message or instruction that container 102 is full of liquid should be removed from the printer, to be replaced with a new, empty liquid collection container.

Figure 3A:
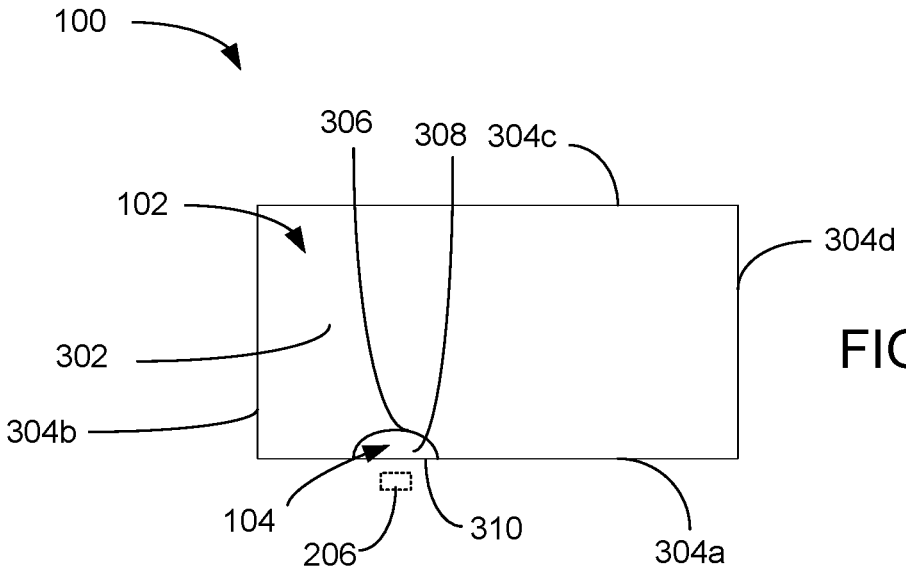
FIGS. 3A and 3B are simple schematic diagrams that illustrate top down views of examples of a system for collection of liquid ejected from a printhead.
Figure 3B:
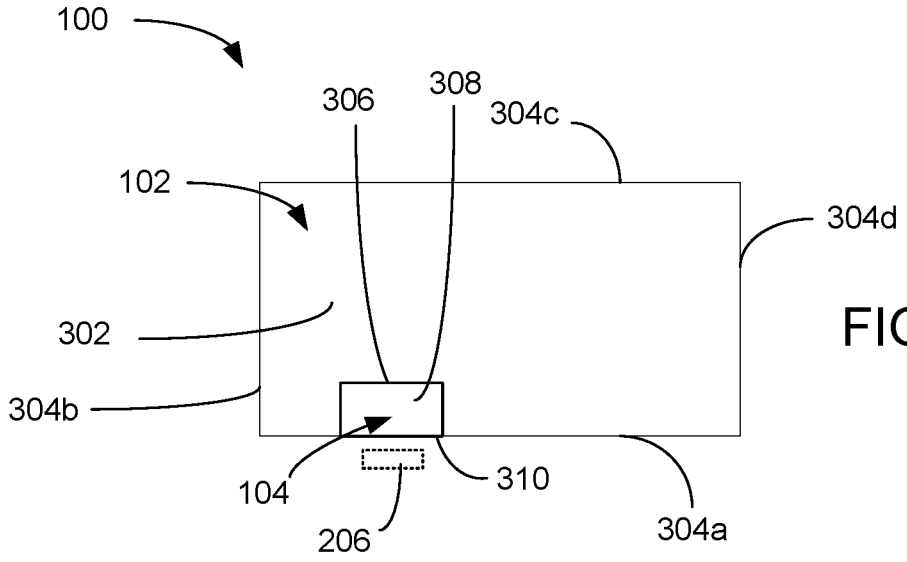

FIGS. 3A and 3B are simple schematic diagrams that illustrate top down views of examples of a system for collection of liquid ejected from a printhead. FIG. 3A provides an example of a disposable container 102 with a floor 302 and container walls 304*a* 304*b* 304*c* 304*d*. In this example, an overflow pocket 104 is formed by a portion 308 of the container floor, a portion 310 of one of the container walls 304*a*, and a connecting member 306. In the example of FIG. 3A, container wall portion 310 and connecting member 306 form a semi-circular or oval shaped overflow pocket 104. In the example of FIG. 3B, container wall portion 310 and connecting member 306 form a rectangular shaped overflow pocket 104. In examples, one or all of the components of the disposable container 102 (e.g., container floor 302, container walls container walls 304*a* 304*b* 304*c* 304*d*, overflow pocket 104 (formed by a portion 308 of the container floor 302, a portion 310 of one of the container walls 304*a*, and connecting member 306) may be a plastic or other polymer. In other examples, any one or more of the components of disposable container 102 or overflow pocket 104 may be or include a glass, a metal, or an organic material.

In the examples of FIGS. 3A and 3B, system 100 includes a sensor 206 situated outside disposable container 102 and adjacent the portion 310 of the container wall 304*a* that forms overflow pocket 104. Sensor 206 is to detect liquid in overflow pocket 104, and to send a signal or message for a user to remove disposable container 102 from a printer and replace disposable container 102 with a new disposable container that does not contain liquid spit from printheads. In particular examples sensor 206 is an inductive sensor or a capacitive sensor that is to detect the presence of liquid overflow pocket 104, rather than determine a particular amount of liquid in overflow pocket 104. As a result, in such particular examples user replacement of disposable container 102 with a new container does not require that sensor 206 be reset or calibrated.

FIGS. 4A, 4B, and 4C are simple schematic diagrams that illustrate a top down view and profile views of examples of a system for collection of liquid ejected from a printhead. FIGS. 4A, 4B, and 4C provide examples of a disposable container 102 with a floor 302 and container walls 304*a* 304*b* 304*c* 304*d*. In this example, an overflow pocket 104 is formed by a portion 308 of the container floor, a portion 310 of one of the container walls 204*a*, and a connecting member 306 (connecting member 306 is sometimes referred to herein as an overflow wall). In the example of FIGS. 4A, 4B, and 4C container wall portion 310 and connecting member 306 form a rectangular shaped overflow pocket 104.

In the examples of FIGS. 4A, 4B, and 4C a sensor 206 is situated in the printer outside of disposable container 102 and adjacent to the portion 310 of the container wall 304*a* that forms overflow pocket 104. Sensor 206 is to detect liquid 402 (indicated by a dotted pattern in FIGS. 4A and 4B) in overflow pocket 104, and to send a signal or message for a user to remove container 102 from a printer and replace container 102 with a new disposable container that does not contain liquid spit from printheads.

In the example of FIGS. 4A and 4B, the walls 304*a* 304*b* 304*c* 304*d* of container 102 have a uniform height. Connecting member 306 extends upward from container floor 302 (e.g., portion 308 of container floor 302) and has a height 404 that is less than the height 406 of the portion 310 of container wall 304*a* that is a boundary of overflow pocket 104.

In other examples, the walls 304*a* 304*b* 304*c* or 304*d* may not have a consistent height. For instance, in the example of FIG. 4C the wall 304*a* with a portion 310 that forms overflow pocket 104 has a slope. In another example, the wall 304*a* that has a portion that forms the overflow pocket might have a stepped or other irregular height. In such examples the connecting member 306 that extends upward from container floor 302 is to have a maximum height 404 that is less than the lowest point 408 of the portion 310 of the container wall 304*a* that helps form overflow pocket 104. In this manner is assured that the liquid 402 collected in overflow pocket 104 does not spill over the portion 310 of wall 304*a*.

FIGS. 5A and 5B are top down views of an example of a service station 500 system for servicing a printhead. Beginning at FIG. 5A, Service station 500 includes a disposable container 102. Disposable container 102 includes a main cavity 502 that is formed by first wall 504*a*, second wall 504*b*, third wall 504*c*, a fourth wall 504*d*, and a floor 302. Each of the first, second, third, and fourth walls has a minimum height of at least "x." Disposable container 102 includes a subcavity 104 that serves as an overflow pocket to the main cavity 502. Subcavity 104 is formed by a portion 310 of first wall 504*a*, by an overflow wall 306 with a height "y" that is less than "x", and a portion of the floor 302. Subcavity 104 is to collect spit liquid that has overflown from main cavity 502 of container 102.

Moving to FIG. 5B, in examples service station 500 may include a sensor 206 situated outside disposable container 102 and adjacent to the portion 310 of first wall 504*a* that partially defines subcavity 104. Sensor 206 is to detect the collected liquid in subcavity 104. In examples, sensor 206 may be positioned outside disposable container 102 upon a supporting member (not depicted in FIG. 5B) or some other element of service station 100 such that sensor 206 is adjacent to subcavity 104. Thus, when a user removes disposable container 102 from service station 100 sensor 206 is left undisturbed. In this manner sensor 206 remains in the correct position to operate in conjunction with a new, empty disposable container that a user installs to replace filled disposable container 102.

FIGS. 6A, 6B, and 6C are simple schematic diagrams that illustrate top down views of additional examples of a system 100 for collection of liquid ejected from a printhead. FIG. 6A provides an example of a disposable container 102 with a floor 302 and container walls 304*a* 304*b* 304*c* 304*d*. In this example, an overflow pocket 104 is formed by a portion 308 of the container floor, a first portion 310 of one of the container walls 304*a*, a second portion 602 of a second of the container walls 304*b* and a connecting member 306. In the example of FIG. 6A, first container wall portion 310, second container wall portion 602, and connecting member 306 form a semi-circular or oval shaped overflow pocket 104. In the example of FIG. 6B, first container wall portion 310, second container wall portion 602, and connecting member 306 form a rectangular shaped overflow pocket 104. In the example of FIG. 6C, first container wall portion 310, second container wall portion 602, and connecting member 306 form a triangle shaped overflow pocket 104. In examples, one or all of the components of the disposable container 102 (e.g., container floor 302, container walls container walls 304*a* 304*b* 304*c* 304*d*, and overflow pocket 104 may be a plastic, another polymer, a glass, metal, or an organic material.

In the examples of FIGS. 6A, 6B, and 6C, system 100 may include a sensor 206 situated outside disposable container 102 and adjacent the first portion 310 of the container wall 304*a*, or the second portion 602 of the container wall 304*b*, that forms overflow pocket 104.

FIGS. 7A and 7B are simple schematic diagrams that illustrate a top down view and profile views of examples of a system for collection of liquid ejected from a printhead. In this example, an overflow pocket 104 is formed by a portion 308 of the container floor, a first portion 310 of one of the container walls 204*a*, a second portion of another of the container walls 304*b*, and a connecting member 306. In the example of FIGS. 7A and 7B container wall portion 310 and connecting member 306 form a rectangular shaped overflow pocket 104.

In the examples of FIGS. 7A and 7Ba sensor 206 is situated in the printer outside of disposable container 102 and adjacent to the first portion 310 of the container wall 304*a* that forms overflow pocket 104. In other examples, the sensor may be situated outside of disposable container 102 and adjacent to second portion 602 of the container wall 304*b* that forms overflow pocket 104. Sensor 206 is to detect liquid 402 (indicated by a dotted pattern in FIGS. 7A and 7B) in overflow pocket 104, and to send a signal or message for a user to remove container 102 from a printer and replace container 102 with a new disposable container that does not contain liquid spit from printheads.

FIGS. 8A and 8B are top down views of another example of a system for collection of liquid ejected from a printhead. Beginning at FIG. 8A, Service station 800 includes a disposable container 102. Disposable container 102 includes a main cavity 802 that is formed by first wall 804*a*, second wall 804*b*, third wall 804*c*, a fourth wall 804*d*, and a floor 802. Each of the first, second, third, and fourth walls has a minimum height of at least "x." Disposable container 102 includes a subcavity 104 to the main cavity 802. Subcavity 104 is formed by a first portion 310 of first wall 804*a*, a second portion 602 of second wall 804*b*, by an overflow wall 306 with a height "y" that is less than "x", and a portion of the floor 802. Subcavity 104 is to collect spit liquid that has overflown from main cavity 802 of container 102 depicted in FIGS. 8A and 8B.

Overflow wall 306 that extends upward from container floor 802 has a maximum height y that is less than the lowest point of any of the container walls 804*a* 804*b* 804*c* 804*d*. In the example depicted in FIGS. 8A and 8B container walls 804*a* 804*b* 804*c* 804*d* of disposable container 102 have a uniform height. In other examples container walls 804*a* 804*b* 804*c* and 804*d* may have varying heights. Overflow wall 306 having height y that is less than the lowest of any of container walls 804*a* 804*b* 804*c* and 804*d* causes liquid 402 in main cavity 802 to into overflow pocket 104 before overflowing any of walls 804*a* 804*b* 804*c* 804*d*.

In the foregoing discussion of FIG. 2, spit engine 208 and alert engine 210 were described as combinations of hardware and programming. Engines 208 and 210 may be implemented in a number of fashions. Looking at FIG. 9 the programming may be processor executable instructions stored on a tangible memory resource 930 and the hardware may include a processing resource 940 for executing those instructions. Thus, memory resource 930 can be said to store program instructions that when executed by processing resource 940 implement system 100 of FIG. 2.

Memory resource 930 represents generally any number of memory components capable of storing instructions that can be executed by processing resource 940. Memory resource 930 is non-transitory in the sense that it does not encompass a transitory signal but instead is made up of a memory component or memory components to store the instructions. Memory resource 930 may be implemented in a single device or distributed across devices. Likewise, processing resource 940 represents any number of processors capable of executing instructions stored by memory resource 930. Processing resource 940 may be integrated in a single device or distributed across devices. Further, memory resource 930 may be fully or partially integrated in the same device as processing resource 940, or it may be separate but accessible to that device and processing resource 940.

In one example, the program instructions can be part of an installation package that when installed can be executed by processing resource 940 to implement system 100. In this case, memory resource 930 may be a portable medium such as a CD, DVD, or flash drive or a memory maintained by a server from which the installation package can be downloaded and installed. In another example, the program instructions may be part of an application or applications already installed. Here, memory resource 930 can include integrated memory such as a hard drive, solid state drive, or the like.

In FIG. 9, the executable program instructions stored in memory resource 930 are depicted as spit module 908 and alert module 910. Spit module 908 represents program instructions that when executed by processing resource 940 may perform any of the functionalities described above in relation to alert engine 208 of FIG. 2. Alert module 910 represents program instructions that when executed by processing resource 940 may perform any of the functionalities described above in relation to alert engine 210 of FIG. 2.

FIG. 10 is a flow diagram of implementation of a method for collection of liquid ejected from a printhead. In discussing FIG. 10, reference may be made to the components depicted in FIGS. 2 and 9. Such reference is made to provide contextual examples and not to limit the manner in which the method depicted by FIG. 10 may be implemented. A printhead is caused to spit a liquid into a main cavity of a container. The container also includes a subcavity or overflow pocket for collecting liquid that has overflown from the main cavity (block 1002). Referring back to FIG. 2 and FIG. 9, spit engine 208 (FIG. 1) or spit module 908 (FIG. 9), when executed by processing resource 940, may be responsible for implementing block 1002.

A sensor is caused to detect whether liquid is present in the subcavity (block 1004). Referring back to FIG. 2 and FIG. 9, alert engine 210 (FIG. 1) or alert module 910 (FIG. 9), when executed by processing resource 940, may be responsible for implementing block 1004.

Responsive to sensor detection that liquid is present in the subcavity, a message is caused to be sent to a user interface for user consumption (block 1006). Referring back to FIG. 2 and FIG. 9, alert engine 210 (FIG. 1) or alert module 910 (FIG. 9), when executed by processing resource 940, may be responsible for implementing block 1006.

FIGS. 1, 2, 3A, 3B, 4A-4C, 5A and 5B, 6A-6C, 7A and 7B, 8A and 8B, 9, and 10 aid in depicting the architecture, functionality, and operation of various examples. In particular, FIGS. 1, 2, 3A, 3B, 4A-4C, 5A and 5B, 6A-6C, 7A and 7B, 8A and 8B, and 9 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 10 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A system for collection of liquid ejected from a printhead, comprising:

a container having a floor and a container wall; and an overflow pocket formed by a connecting member and a portion of the container wall, wherein the connecting member extends upward from the container floor and has a height that is less than the height of the container wall portion.

2. The system of claim 1, wherein the overflow pocket is to collect liquid for detection by a sensor situated outside the container and adjacent the container wall portion.

3. The system of claim 2, further comprising the sensor.

4. The system of claim 3, wherein the sensor is one of an inductive sensor and a capacitive sensor.

5. The system of claim 3, further comprising an alert engine to, upon receipt of data indicative the sensor has detected liquid print agent in the overflow pocket, cause sending of a user warning message or a user instruction message that the container should be replaced.

6. The system of claim 1, wherein the overflow pocket is formed by a portion of the container floor.

7. The system of claim 1, wherein the connecting member extends upward from the container floor and has a minimum height that is less than the lowest point of the container wall portion.

8. The system of claim 1, wherein the container wall is a first container wall, and wherein the container includes a second container wall and the overflow pocket is formed by a portion of the second container wall.

9. The system of claim 8, wherein the connecting member has a height that is less than the height of the second container wall portion.

* * * * *